US007934549B2

(12) United States Patent
Cimolai

(10) Patent No.: US 7,934,549 B2
(45) Date of Patent: May 3, 2011

(54) PASSIVE HEATING ASSISTED RECOVERY METHODS

(75) Inventor: Mauro Cimolai, Calgary (CA)

(73) Assignee: Laricina Energy Ltd., Calgary (CA)

( * ) Notice: Subject to any disclaimer, the term of this patent is extended or adjusted under 35 U.S.C. 154(b) by 21 days.

(21) Appl. No.: 12/327,510

(22) Filed: Dec. 3, 2008

(65) Prior Publication Data

US 2010/0108317 A1 May 6, 2010

Related U.S. Application Data

(60) Provisional application No. 61/110,901, filed on Nov. 3, 2008.

(51) Int. Cl.
*E21B 43/22* (2006.01)
*E21B 43/24* (2006.01)
*E21B 43/243* (2006.01)

(52) U.S. Cl. ..... 166/258; 166/272.1; 166/272.3; 166/272.6; 166/272.7; 166/302; 166/303

(58) Field of Classification Search ..... None
See application file for complete search history.

(56) References Cited

U.S. PATENT DOCUMENTS 3,116,792 A * 1/1964 Heino ..... 166/245
3,147,804 A * 9/1964 Wyllie ..... 166/258
3,159,215 A * 12/1964 Meldau et al. ..... 166/258
3,167,120 A * 1/1965 Pryor ..... 166/269
3,180,413 A * 4/1965 Willman ..... 166/272.3
3,323,590 A * 6/1967 Gilchrist et al. ..... 166/257
3,372,750 A * 3/1968 Satter et al. ..... 166/272.3
3,599,714 A * 8/1971 Messman et al. ..... 166/258
3,692,111 A * 9/1972 Breithaupt et al. ..... 166/252.1
3,847,219 A * 11/1974 Wang et al. ..... 166/401
3,924,680 A * 12/1975 Terry ..... 166/258
3,978,920 A * 9/1976 Bandyopadhyay et al. .. 166/258
4,669,542 A * 6/1987 Venkatesan ..... 356/243.2
4,886,118 A 12/1989 Van Meurs et al.
4,926,941 A 5/1990 Glandt et al.

(Continued)

FOREIGN PATENT DOCUMENTS

WO WO 2008/048454 A2 4/2008

OTHER PUBLICATIONS

Cimolai, Mauro, "Recovery Potential of the Bitumen—Saturated Grosmont Carbonate" May 20, 2008, Laricina Energy Ltd.

*Primary Examiner* — George Suchfield
(74) *Attorney, Agent, or Firm* — Santosh K Chari; Blake, Cassels & Graydon LLP

(57) ABSTRACT

A method for producing hydrocarbons from a region having adjacent strata divided by an impermeable or partially permeable barrier and, wherein at least one of the strata contains hydrocarbons, comprises of sufficiently heating one of the stratum to allow heat to be conducted to the hydrocarbon containing stratum and producing hydrocarbons therefrom. In one aspect, both strata contain hydrocarbons, such as bitumen, and heat is generated by a steam assisted gravity drainage process to the adjacent stratum. Heat may also be generated by in-situ combustion of hydrocarbons to preheat an adjacent stratum, or by electrical heating. Once pre-conditioned to a higher in-situ temperature, hydrocarbon production may be facilitated by diluting the target pre-heated hydrocarbon bearing stratum with solvent injection.

14 Claims, 7 Drawing Sheets

U.S. PATENT DOCUMENTS 5,016,709 A * 5/1991 Combe et al. ..... 166/245
5,042,579 A 8/1991 Glandt et al.
5,060,726 A 10/1991 Glandt et al.
6,722,431 B2 4/2004 Karanikas et al.
6,918,444 B2 7/2005 Passey et al.
6,991,032 B2 1/2006 Berchenko et al.
7,073,578 B2 7/2006 Vinegar et al.
7,077,198 B2 7/2006 Vinegar et al.
7,320,364 B2 1/2008 Fairbanks
7,849,922 B2 * 12/2010 Vinegar et al. ..... 166/272.1
2001/0049342 A1 * 12/2001 Passey et al. ..... 507/200
2002/0029881 A1 * 3/2002 de Rouffignac et al. ... 166/244.1
2006/0162922 A1 * 7/2006 Chung et al. ..... 166/245
2007/0181299 A1 * 8/2007 Chung et al. ..... 166/245
2008/0135244 A1 * 6/2008 Miller ..... 166/272.6

* cited by examiner

PASSIVE HEATING ASSISTED RECOVERY METHODS

CROSS REFERENCE TO PRIOR APPLICATIONS

This application claims priority from U.S. application No. 61/110,901, filed Nov. 3, 2008, the entire contents of which are incorporated herein by reference.

FIELD OF THE INVENTION

The present invention relates to the production of hydrocarbons from petroleum deposits by in-situ recovery techniques. More specifically, the invention relates to a process employing heat conduction from a first stratum to pre-condition a second stratum containing hydrocarbons such as heavy oil or bitumen, thereby permitting the enhanced recovery of such hydrocarbons.

BACKGROUND OF THE INVENTION

Petroleum deposits of crude oil demonstrate significant variations across in-situ reservoir and fluid properties. Deposits of high viscosity or low API gravity oils (higher density oils) can grade from increasingly difficult to economically produce to being uneconomic to produce under initial reservoir conditions. The limiting physical properties of heavier oils controlling economic flow rates to producing wells, such as the oil viscosity, can be strongly improved by heating. At a higher initial in-situ temperature, a range of recovery techniques that would otherwise not be economically feasible can become effective.

Oil sand deposits are found predominantly in the Middle East, Venezuela, and Western Canada. The Canadian bitumen deposits, being the largest in the world, are estimated to contain between 1.6 and 2.5 trillion barrels of oil, so the potential economic benefit of this invention carries significance within this resource class. The term "oil sands" refers to large subterranean land forms composed of reservoir rock, water and bitumen. They comprise layers of bitumen-rich deposits, which may be internally continuous permitting vertical fluid flow, or otherwise segregated with flow barriers into discrete, adjacent layers. Bitumen is a heavy, black oil which, due to its high viscosity, cannot readily be pumped from the ground like other crude oils. Therefore, alternate processing techniques must be used to extract the bitumen deposits from the oil sands, which remain a subject of active development in the field of practice. The basic principle of known extraction processes is to lower the viscosity of the bitumen by applying heat, injecting chemical solvents, or a combination thereof, to a deposit layer, thereby promoting flow of the material throughout the treated reservoir area, in order to allow for recovery of bitumen from that layer.

FIG. 1 illustrates the relationship between bitumen viscosity and temperature, for a range of oils identified according to API gravity, or oil density. Referring to the curve for an 8 API oil, commonly within the range of Canadian Athabasca bitumen, it can be seen that at in-situ conditions of approximately 10° C., the bitumen viscosity is in the range of 6-7 million centipoise. However, for even a modest temperature increase of 40° C., the bitumen viscosity at 50° C. decreases dramatically to 20,000 cp, while in extending the formation temperature to 100° C., the viscosity would fall to less than 1,000 cp. At these reduced viscosity values, the crude's ability to flow to a producing wellbore is markedly increased. More significantly, however, the effectiveness of alternate recovery techniques applied to such a preconditioned reservoir oil becomes greatly enhanced. The application of recovery strategies to an externally, or passively, pre-heated reservoir volume forms the basis of the present invention.

A variety of known extraction processes are commercially used to recover bitumen from oil deposits. For example, Steam-Assisted Gravity Drainage, commonly referred to as SAGD, involves the injection of steam into a bitumen-containing deposit in order to directly transfer heat to the oil. Steam is a preferred fluid as the latent heat of steam, defined as the heat released when a molecule condenses from vapour to liquid phase, is one of the highest per molecule among all known fluids. This allows the maximum heat transfer per volume of cycle fluid externally introduced into the reservoir. The heat from the injected steam reduces the viscosity of the bitumen and results in mobilization of same. As known in the art, a SAGD process results in condensation of the steam into liquid water, which is in effect introduced into the reservoir as a collateral contaminant to the heat transfer process through the physical phase change of the water. The mobilized bitumen must therefore flow with the introduced water, where the relative permeability of the water/oil mixture is reduced, leading to potentially poorer oil productivity and overall recovery. In addition, the mixture can form emulsions within the deposit, which block, or retard, bitumen flow. The water is also recovered with the bitumen, necessitating additional costs for pumping, separation and treating at surface, while also acting to remove heat within the produced fluid volumes. Consequently, while water is a pragmatic heat transfer medium, it also introduces a range of undesirable consequences for bitumen recovery.

Furthermore, the SAGD process is only an economically feasible option for larger deposits as measured by metrics of minimum formation thickness or bitumen volume. For example, it is common in the art to use SAGD processes only on deposits having a threshold thickness, commonly greater than 15-20 m, dependent on specific considerations such as ore grade or economic limitations subject to the evolving fiscal regime. The economics of a SAGD process are directly influenced by the costs of handling the water circulation through the reservoir. Consequently, an alternate technique to remove the need for water handling in heating a formation would be of strong economic benefit. Such a process can be achieved by heating an oil deposit externally, where the complications developed in the art introducing heat into a reservoir directly, or from within a producing zone, are eliminated.

Dilution is another technique with potential application in the extraction of bitumen from oil sand or heavy oil deposits. A dilution process involves the injection of a physical solvent, such as light alkanes or other relatively light hydrocarbons, into a deposit, similar to the procedure used in steam injection, to dissolve heavy oil or bitumen in the solvent. This technique also reduces the viscosity of the bitumen, thereby allowing the recovery of the bitumen-solvent mixture that is mobilized throughout the reservoir. Condensing hydrocarbon solvents have also been proposed in the literature, where a reduced level of heat is introduced in the reservoir from the vapour to liquid phase change, in addition to the subsequent solvent dilution effect. See for example: Nenniger, J. E. and Dunn, S. G., "How Fast is Solvent Based Gravity Drainage?", CIPC 59$^{th}$ Annual Technical Meeting, Calgary, Jun. 17-19, 2008, paper 2008-139). However, the condensing hydrocarbon strategy is a further example where heat is introduced directly to the produced zone by means of the working fluid.

Solvents that can be used in effective dilution strategies include lower molecular weight alkanes (ethane through to dodecane), common transportation diluent mixtures, kerosene, naphta, flue gas and carbon dioxide. Carbon dioxide may be of particular interest as large quantities may otherwise be available from such processes as steam generation. Immiscible carbon dioxide injection is demonstrated to have a strong effect on bitumen viscosity reduction and can be recirculated in a recovery process to permit a level of ultimate underground storage, or sequestration.

It is increasingly common to apply a combination of heat and dilution processes in order to recover an economically significant amount of bitumen from solvent-assisted steaming processes. Solvent aided or solvent assisted processes, SAP techniques, involve the addition of a hydrocarbon solvent to steam. Some modest success has been reported with SAP techniques, which are currently under active development. However an inherent difficulty with SAP techniques remains the introduction of liquid water into the reservoir. Water acts as an effective barrier to solvent, limiting the full efficiency of solvent in a SAP process. Thus, known SAP processes remain disadvantageous by introducing water into the reservoir.

Consequent to the net removal of bitumen and related fluids from a reservoir, pressure depletion would develop within the deposit. This could deter from bitumen production by impeding the reservoir energy for artificial lift of fluids to surface, or create a pressure sink for fluid migration, such as in bounding water zones, to enter the treated zone. The above mentioned recovery processes use the injection of fluids, such as steam or solvents, to replace the volume occupied by the extracted bitumen within the deposit, thus preventing the development of reservoir pressure depletion. The injection of a solvent, such as for example $CO_2$, to replace reservoir voidage within a preheated working chamber can be used to advantage as both providing pressure maintenance and as a dilution agent as outlined in this invention.

Thermal processes for bitumen recovery within a deposit inherently involve heat losses to surrounding rock strata. Due to the physical nature of a petroleum deposit, heat introduced into a bitumen reservoir is dissipated throughout the target area and is conducted to surrounding structures including adjacent hydraulically isolated bitumen deposits. This results in higher process cost, as a portion of the energy supplied to heat the target bitumen area is transferred to other regions within the deposit, resulting in a loss of thermal efficiency.

The prior art methods of bitumen recovery have focused primarily on transferring heat directly to or generating heat directly within the targeted reservoir and extracting production directly from the same single hydraulically continuous stratum within an oil sand or heavy oil reservoir. This strategy is logically inherent to a steaming process, as the highest temperature with more favoured changes or improved bitumen characteristics (lowest viscosity) is achieved at the entry point of steam injection within a reservoir. Prior to further heat losses, heavy oil or bitumen removed at this point has the best physical flow properties for optimal productivity and/or recovery. Heated bitumen, initial formation waters, water condensed from injected steam and non-condensable gases are extracted from the formation to which heat was initially supplied. Heat losses to the bounding formation is accepted as a necessary physical consequence of the thermal process in a SAGD operation. Consequently, SAGD suffers from both thermal inefficiencies of heat losses outside of the producing formation and further heat losses from produced fluids within the formation.

Such prior art techniques have attempted to overcome some issues of heat loss due to lateral heat conduction to horizontally adjacent areas by incorporating a plurality of heaters, isolating the treatment area by frozen barriers, and by electrically heating an internal non-bitumen rock layer, such as an internal sequence of shale stringers, to allow heat to transfer internally directly to the desired bitumen-rich layer.

For example, U.S. Pat. Nos. 6,991,032 and 7,225,866 disclose a modified thermal process for bitumen extraction using an arrangement of several heating wells and several production wells dispersed throughout a single deposit layer. U.S. Pat. No. 7,073,578 describes a thermal process for heating two sections of a single deposit using two sets of heating sources, one for each section, and leaving a third, unheated section between them.

There are several patents describing recovery techniques for extracting kerogen from solid oil shale layers within an oil sand deposit. For example, U.S. Pat. Nos. 4,886,118; 6,722,431; and 7,040,400 refer specifically to the recovery of kerogen from an oil shale layer within a single deposit. They relate to a deposit having layers of varying permeability that are conductively heated from either a heat source applied to another portion of the deposit, or applied directly to the oil shale layer.

Other examples of known bitumen recovery processes are provided in the following: U.S. Pat. Nos. 7,077,198; 4,926,941; 5,042,579; 5,060,726; and WO/2008/048454

In general, the prior art methods have primarily focused on producing bitumen from within a single reservoir or stratum. However, in some cases, bitumen deposits are located in vertically adjacent reservoirs or stratum separated by a natural barrier. Such barriers hydraulically restrict the movement of fluids between layers, but do not restrict heat transfer between layers as the reservoir rock in such barriers does not provide an insulating capacity limiting heat conduction. Such barriers may be a geological formation, such as rock, shale, or mudstone. In such cases, it is common for a separate heating and production process to be carried out for both strata, where specific economic criteria permit (such as adequate pay thickness, hydrocarbon saturation and reservoir permeability). If the economic criteria for individual layer exploitation are not met, then either all or a subset of the layers may not be exploitable by SAGD. Further, in the case of SAGD, the injection of steam in both regions extends the problems associated with the mixing of water and bitumen and related thermal inefficiencies. Therefore, there exists a need for an improved bitumen recovery process.

Consequently, the essence of the invention is to provide a means to precondition a reservoir oil volume by indirect, or passive heat conduction from heat-generating operations in an adjacent, hydraulically isolated layer. Once heated, a range of techniques for production operations in the adjacent layer can then be optimally designed and applied.

SUMMARY OF THE INVENTION

The invention disclosed herein relates to an improved thermal process for oil sands and/or heavy oil recovery utilizing heat conduction losses from one stratum to recover bitumen in an adjacent stratum.

In one aspect, the invention provides a strategy being an improvement over the art herein discussed, overcoming the consequences of water contamination during steam heating and the need to actively preheat, or otherwise condition, a solvent prior to bitumen dilution.

In one aspect of the invention, a SAGD, steam-assisted gravity drainage thermal process for extracting bitumen from a primary target stratum is used and a secondary bitumen recovery system is placed in an adjacent stratum of the oil deposit. In one embodiment, the secondary stratum is above or below the primary target stratum. This secondary zone is separated from its adjacent stratum by a hydraulically impermeable formation. Thus, the conductive heat losses from the actively heated primary zone act to passively heat the deposit in the secondary zone. The oil in the secondary zone is heated and thus has a lowered initial viscosity. When the viscosity is sufficiently lowered to induce flow of the oil within the zone, production wells can directly recover mobilized hydrocarbons from the second stratum on a "primary" production basis.

In another aspect of the invention, a secondary dilution process can be applied to the target oil in the second stratum in conjunction with the above mentioned passive heat transfer. In the case of a very heavy oil, or bitumen deposit, a dilution process applying a solvent may not be practical or effective at initial in-situ temperatures, therefore the preconditioning of the stratum by passive heat conduction may be a necessary condition to successfully apply a dilution process. Therefore, the bitumen that is not mobilized by passive conductive heating alone can be recovered using by the collateral process of solvent dilution.

In yet another aspect of the invention steam is applied to a non-bitumen containing primary zone, resulting in the conduction of heat to an adjacent, bitumen-containing secondary zone, from which production wells can recover subsequently mobilized bitumen.

In another aspect of the invention, a hydrocarbon bearing first stratum can be used as the heat source to passively heat an adjacent zone. For example, if a first hydrocarbon containing stratum is not exploitable by SAGD, or otherwise not economically producible, the hydrocarbon in the first stratum may be combusted in-situ, thereby generating heat energy that is transferred via conduction to adjacent bitumen or heavy oil bearing zones. Oil can then be produced from the adjacent zone by the techniques previously outlined.

In general terms, an embodiment of the present invention provides a hydrocarbon production method utilizing passive heat transfer from thermal processes actively applied to one zone to pre-heat a heavy oil in a neighbouring zone, as opposed to most currently known methods in the art where heat is applied directly within the produced zone. This method provides an improvement over prior techniques as it does not introduce water to at least one of the hydrocarbon containing formation intervals. Furthermore, the present invention provides an energy efficient method for heavy oil recovery, as the heat losses from producing oil from one reservoir are employed to enhance or assist in the production of another reservoir, thereby increasing production yields and thermal efficiencies for subsurface heating processes.

Thus, according to one aspect, the invention provides a method of producing hydrocarbons from a subterranean formation comprising at least a first stratum and an adjacent, hydrocarbon containing second stratum, said first and second strata being separated by a barrier, the method comprising:

heating the first strata;

allowing heat from the first strata to be conducted into the second strata, said heat being sufficient to pre-condition the hydrocarbons in said second strata in reducing the oil viscosity, permitting the effective application of ancillary recovery strategies; and, producing said hydrocarbons from the second strata.

BRIEF DESCRIPTION OF THE DRAWINGS

Exemplary embodiments of the invention will now be described by way of example only with reference to the accompanying drawings, in which.

DETAILED DESCRIPTION OF THE INVENTION

Figure 1:
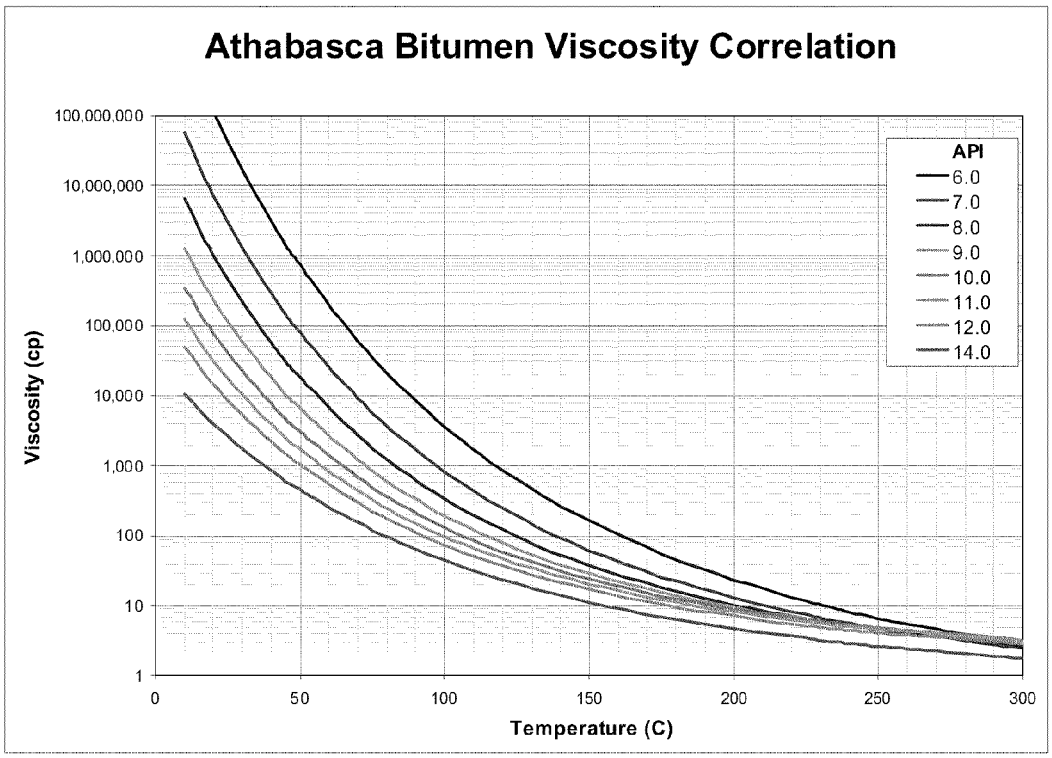
FIG. 1 is a graph illustrating the correlation between Canadian Athabasca heavy oil/bitumen viscosity and the temperature of the deposit.

For clarity of understanding, the following terms used in the present description will have the definitions as stated below:

"Reservoir", "formation", "deposit", "stratum", and "zone" all are synonymous terms referring to a single area within a reservoir that can contain hydrocarbon layers, non-hydrocarbon layers, and any combination thereof;

"Stacked zones" refers to a type of geological configuration consisting more than one reservoir, or the like, disposed adjacent one another, where said zones are separated by a barrier.

As used herein, the term "barrier" will be understood to mean a physical formation that separates two or more heavy oil containing strata. A barrier according to the invention may be impermeable, thereby preventing hydraulic flow of the heavy oil present on opposite sides thereof. However, the invention may also be used in cases where the barrier is semi-permeable. That is, the barrier may be sufficiently permeable to allow some degree of reservoir fluids therethrough. However, such flow would generally be insufficient to impair the commercial viability of the passive heating process. It is also known that a barrier within a formation may change characteristics over time from being impermeable to partially impermeable to flow of heavy oil. Such change may be related to the depletion of adjacent heavy oil deposits, thermally induced geomechanical effects, etc. Although the invention is particularly suited for use in formations having an impermeable barrier, it will be understood that the invention may be equally applicable to formations with leaky barriers that allow a limited degree of heavy oil flow.

"Oil sands" will be used herein by way of example. However, as discussed herein, the invention is applicable for use with reservoirs of oil sands (as the term is known in the art), as well as other heavy oil hydrocarbon materials (i.e. heavy crude oil). However, for convenience, the term "heavy oil" is used for the purposes of the following description and will be understood to refer generally to any of the above mentioned hydrocarbon materials. The choice of such term serves to facilitate the description of the invention and is not intended to limit the invention in any way.

It will be understood that the terms "vertically" and "horizontally" and "vertical" and "horizontal", as may be used herein, are intended to describe in general terms the arrangement or orientation of wells and/or deposits etc. Unless otherwise indicated, these terms are not intended to limit the invention to any particular or specific orientation.

In the following description, reference will be made to the attached figures for facilitating understanding of the invention. It will be understood that the figures are intended merely to illustrate specific aspects or examples of the invention and are not intended to be limiting the scope of the invention. Further, various reference numerals are used in the figures. Elements that are depicted in the figures and which are common to two or more figures are identified with common reference numerals for convenience.

As discussed above, two of the known techniques to reduce in situ bitumen viscosity comprise heating the bitumen and dilution of the bitumen with an injected solvent.

As also discussed above, one common method to effectively raise the temperature of hydrocarbons within a reservoir involves a process known as Steam Assisted Gravity Drainage, or SAGD. In this process, steam is injected into a target reservoir through a horizontal injection well to heat heavy crude oil within a reservoir. The range of temperatures, and corresponding viscosities, required to achieve an economic flow rate is dependent on the specific reservoir permeability. SAGD, and most recovery strategies, are focused on increasing bitumen temperature within a limited region around a steam injection well. The reduced-viscosity oil is then allowed to flow by gravity drainage to an underlying point of the reservoir and to be collected by a horizontal production well. The heavy oil/bitumen is then brought to the surface for further processing. Various pumping equipment and/or systems may be used in association with the production well. Although effective, stand alone SAGD processes have several associated inefficiencies. Firstly, the process is very energy intensive in that a great deal of energy is required to heat the volumes of water to generate the steam used for the heat transfer process, with many heat loss inefficiencies throughout the process. Further, upon condensation of the steam, the resulting water mixes with the mobilized bitumen and may lead to additional inefficiencies. For example, the water-bitumen mixture may have a reduced flow rate and may require more energy for the pumping operation. In addition, the subsequent separation of the bitumen and water requires further processing and costs associated with such procedures. Also, as common with other known active heating methods, the energy input to the deposit is often transferred to neighbouring geological structures and lost by way of conduction. Thus, the process becomes more energy intensive in order to achieve sufficient heating of the target formation fluid. Furthermore, SAGD processes are only commercially viable for reservoirs having a minimum volume, such as, for example, reservoirs less than an economic thickness. In the result, the SAGD process is often uneconomical for deposits having a size smaller than a minimum volume.

FIG. 1 illustrates the effect of heat on bitumen viscosity. The curves for varying oil density, or API gravity, show a maximum slope at the lower temperatures, indicating that small initial in-situ formation temperature increases produce the largest reductions in oil viscosity per degree of temperature rise.

Figure 2:
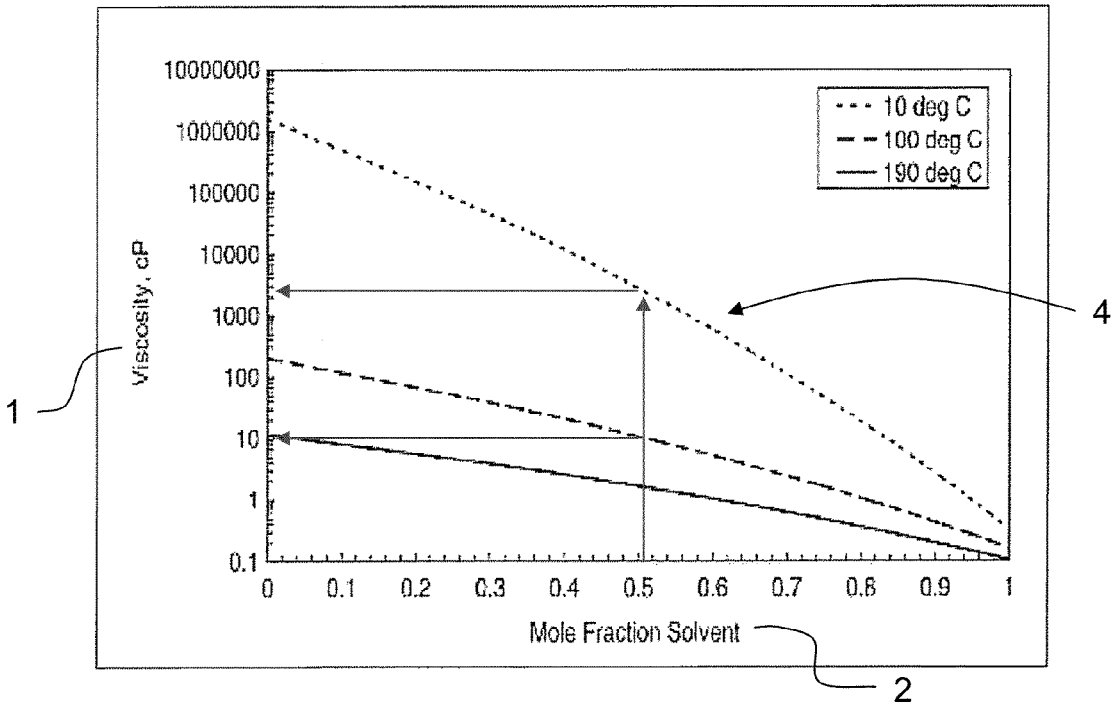
FIG. 2 is a graph illustrating the correlation between Athabasca bitumen viscosity and the volume of solvent added to the deposit.

FIG. 2 illustrates the effect of solvent injection on bitumen viscosity. The graph shows the correlation of the mole fraction of solvent 4, the solvent in this example being hexane, with the bitumen viscosity 1. The top dotted curve 4 for solvent at 10° C. demonstrates that as the mole fraction of hexane 2 in a hexane/bitumen solution increases, the viscosity 1 of the mixture can be reduced from millions of centipoises a viscosity of less than 10 centipoise. However, in comparison with described SAGD processes, pure unheated solvent applications have proven much more difficult to execute in practice, with numerous uneconomic field trials attempted.

To improve the utility of dilution techniques, the prior art provides methods wherein the target area is preheated. It is a known fluid property relationship that as the viscosity of the bitumen is reduced, the value of its diffusion coefficient and the mass flux of bitumen mobilization increases. Consequently, by preheating a bitumen-rich deposit, to any degree, and thereby lowering the viscosity of the contained bitumen, the efficiency of subsequent dilution processes are greatly improved.

According to one aspect, the invention provides a preheating treatment to improve the efficiency of bitumen recovery from a subterranean heavy oil deposit. In one particular aspect, the invention is suited for recovery from two adjacent deposits separated by a geological barrier that is either impermeable or partially permeable to flow of heavy oil therethrough. In another aspect, the adjacent deposits may comprise "stacked zones", which, as indicate above, is a term in the art denoting two adjacent but separated oil sand deposits or zones that are generally vertically segregated.

Figure 3:
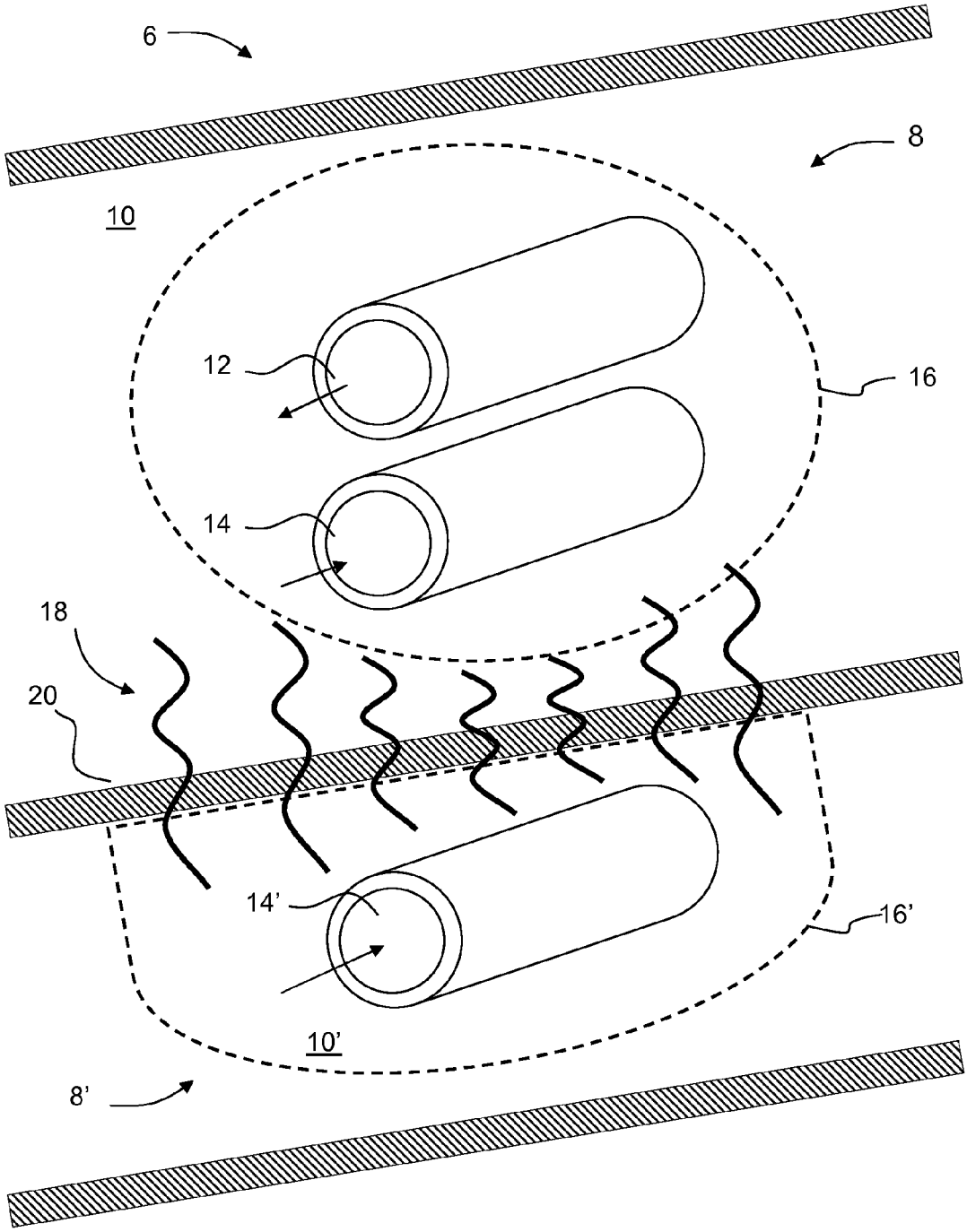
FIG. 3 shows the arrangement of a SAGD process in a first stratum containing bitumen and the recovery of bitumen from a second adjacent stratum.

FIG. 3 illustrates the general arrangement of one embodiment of the invention for extracting bitumen from a stacked zone deposit. As shown, a stacked-zone oil deposit 6 contains a first stratum 8 which contains a bitumen or heavy oil rich area 10. To recover the bitumen from this first stratum 8, a heating process, such as a SAGD process, may be performed in order to reduce the viscosity of the bitumen in area 10 and to promote mobility. As discussed above, a SAGD process is well known in the art. In the case of a SAGD process, at least one steam injection well 12 is positioned within the first stratum 8 to inject steam into the bitumen-rich area 10. Generally, the injection well 12 is positioned in a lower portion of the stratum 8. Further, at least one production well 14 is provided in the stratum 8 and also located in a lower portion thereof and displaced generally vertically below the steam injection well 12. In the present description, all wells will generally be described in the singular form but, as will be known to persons skilled in the art, any number of wells may be used depending on various factors such as the size of the deposit, the amount of pumping equipment available etc. As described further below, the SAGD process influences the characteristics of material in an affected zone 16 within the first stratum 8. As with known SAGD processes, the steam injection well 12 releases steam through outlets (not shown), which may be disposed along its length, into the hydrocarbon-rich area 10 in the first stratum 8. The steam flows through to the bitumen-rich area 10 and releases heat energy therein and, in the result, the steam condenses into liquid water. This transfer of heat energy raises the temperature of the surrounding bitumen and reduces the bitumen viscosity within the stratum 8. The lower viscosity bitumen is then rendered mobile and the mobilized bitumen from the affected area 16 enters the production well 14 through inlets (not shown), which may be disposed along its length. As known in the art, various types of pumping equipment and systems may be used for production processes.

As illustrated in FIG. 3, and according to one aspect of the invention, heat, depicted by arrows 18, from the first stratum 8 is conducted through a barrier 20 separating the first stratum 8 from an adjacent second stratum 8'. In the example shown in FIG. 3, the strata 8 and 8' are generally vertically separated, thereby forming a "stacked zone". The second stratum 8' contains a second bitumen-rich area 10' from which mobilized bitumen can be recovered according to the invention. That is, according to an aspect of the invention, heat 18 transferred from the first stratum 8 serves to passively heat the bitumen in a second affected area 16' in the second stratum 8', thereby reducing its viscosity and promoting mobility without the aid of a direct heat source within the stratum 8'. For this purpose, a second production well (or wells) 14' is disposed in the second stratum 8' to collect the mobilized bitumen from the second bitumen-rich area 10'. It should be noted that the mobilized bitumen from the first stratum 8 is either unable to pass into the second stratum 8' due to impermeable properties of the barrier 20 or is able to pass to a limited degree in the case of a partially permeable barrier. However, barrier 20 does allow the transfer of heat via conduction to pass from the first stratum 8 (wherein a typical SAGD process is used) to the second stratum 8'.

Figure 4:
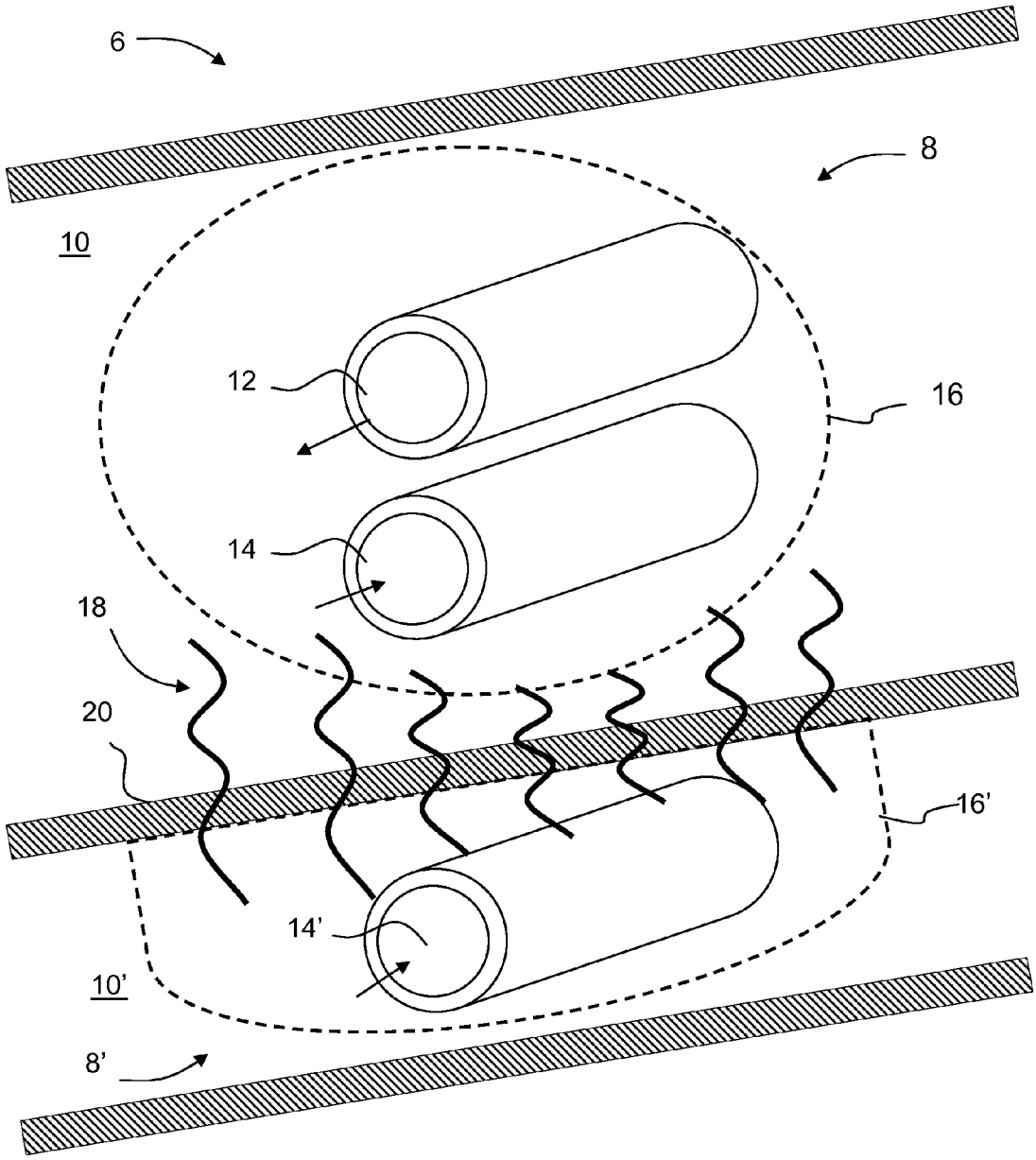
FIG. 4 shows the arrangement of a SAGD process in a first stratum containing bitumen and the recovery of bitumen in a second stratum, whereby the said second stratum is smaller than said first stratum and may not be economically recoverable by SAGD on a stand alone basis.

The method of the invention can be used in cases where one stratum is smaller in size or volume than another adjacent stratum, rendering the smaller stratum otherwise uneconomic for a SAGD process. That is, as known in the art, the deposit must contain a sufficient amount of heavy oil or must be of a sufficient thickness for a SAGD application to be economically or practically viable. For example, in some cases, a deposit must have a minimum thickness for a SAGD treatment to be worthwhile. In some cases, such economically unviable deposits may lie adjacent, but separated, from a more plentiful deposit where a SAGD operation is warranted. An example of such a case is shown in FIG. 4, where a first stratum 8 has a sufficient thickness t for a SAGD process lies adjacent to a second stratum 8' with an insufficient thickness t'. As shown, a typical SAGD operation may be conducted in the first stratum 8', wherein a steam injection well 12 is used along with a production well 14. In the second stratum, a production well 14' is inserted for producing bitumen that is heated by conduction from the process conducted in the first stratum 8. Thus, although a separate SAGD process would not be viable in the second stratum 8', heat can be introduced via conduction 18 from the first stratum 8 into the second stratum 8' thereby allowing recovery of bitumen from an otherwise non-commercial stratum.

Figure 5:
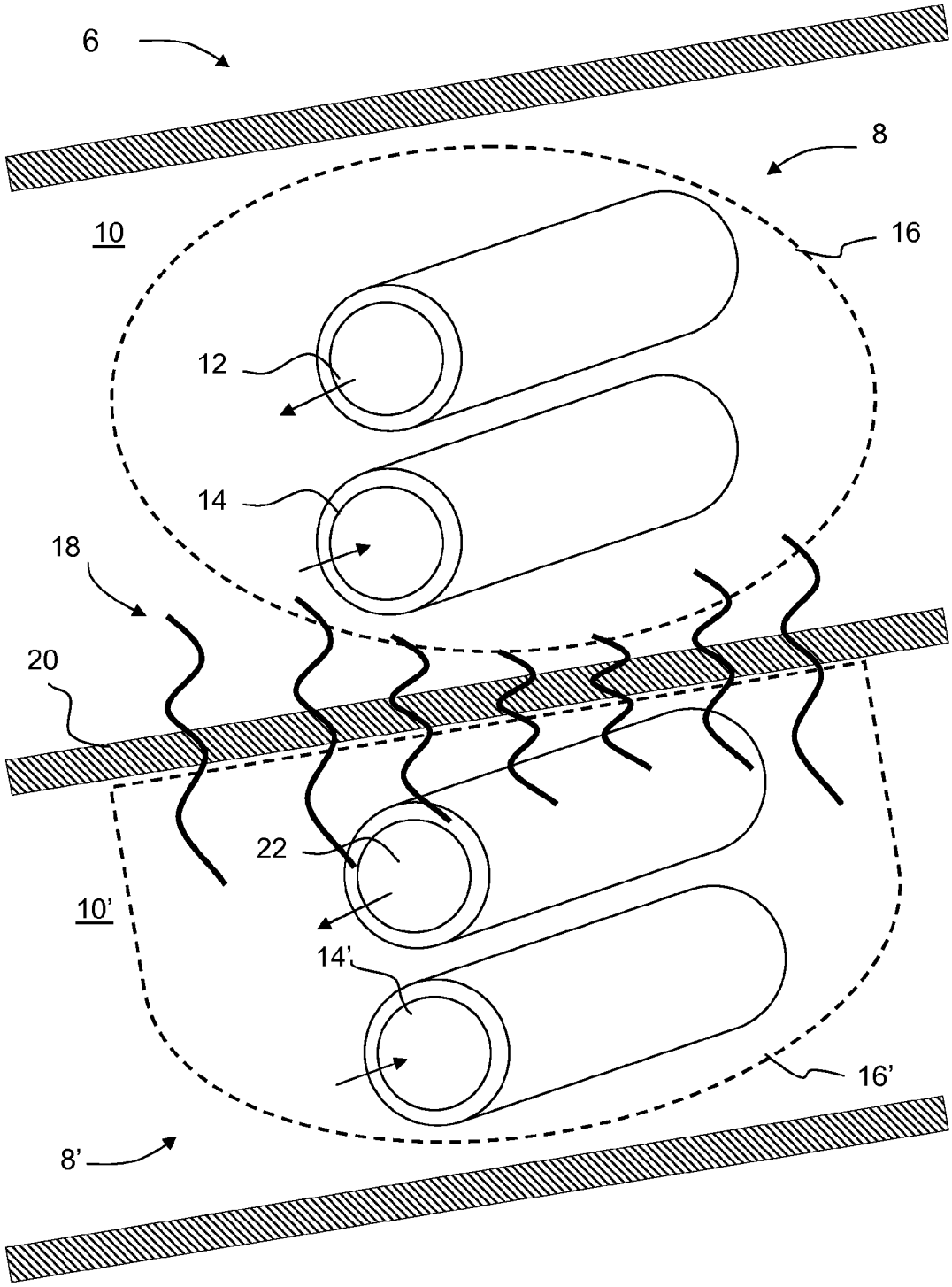
FIG. 5 shows the arrangement of a SAGD process in a first stratum containing bitumen and the recovery of bitumen in a second stratum, where the second stratum also incorporates a dilution process.

A further aspect of the invention is illustrated in FIG. 5. In this case, in addition to the passive heating of a second stratum 8', the invention provides the use of a solvent injection process to further mobilize the heated bitumen in the second stratum 8' and thereby further increase production yield. As shown in FIG. 4, heat 18 is transferred from the first stratum 8 to the second stratum 8'. The heat may, for example, be the result of the SAGD process conducted in the first stratum 8. Such heat may be used to preheat bitumen in the second stratum 8'. In some instances, as determined by the characteristics of the stacked-zone formation 6, the heat 18 transferred from the first stratum 8 may be insufficient to adequately reduce the viscosity of the bitumen in the second stratum 8' to the extent required to promote mobility through the stacked-zone oil sand 6. However, as described above, any degree of heat transfer would facilitate in raising the temperature of the bitumen in the second bitumen-rich area 10' such that the diffusion coefficient of the solvent within the oil is also raised. Therefore, in conjunction with the passive heating method of the invention, a dilution process may also be conducted using an injected solvent. Examples of suitable solvents are known in the art, but can include light alkanes, $C_2$ through $C_{12}$, diluent, naptha, kerosene, $CO_2$ and combinations thereof. In this aspect of the invention, as illustrated in FIG. 5, a solvent injection well 22 can be positioned within the second stratum 8' to inject a solvent, such as a hydrocarbon fluid, into the second bitumen-rich area 10'. This causes the oil (i.e. heavy oil) in the second stratum 8' to be diluted thereby becoming mobilized. The mobilized bitumen is then collected in the second production well 14'. Due to the preheating conditions, more bitumen is able to be diluted by the solvent thereby increasing the production yield of the recovery process in the second stratum 8', and avoiding the use of a heat transfer medium, such as steam, in the second stratum. Thus, in this aspect of the invention, the heat applied in a production process in one stratum is used in a neighbouring stratum, thereby avoiding the need for a further heating step, the costs associated therewith and (as discussed above) the associated impairments to recovery caused by the addition of a water phase to the reservoir. A solvent dilution process in then used to produce the pre-heated bitumen in the neighbouring stratum.

Figure 6:
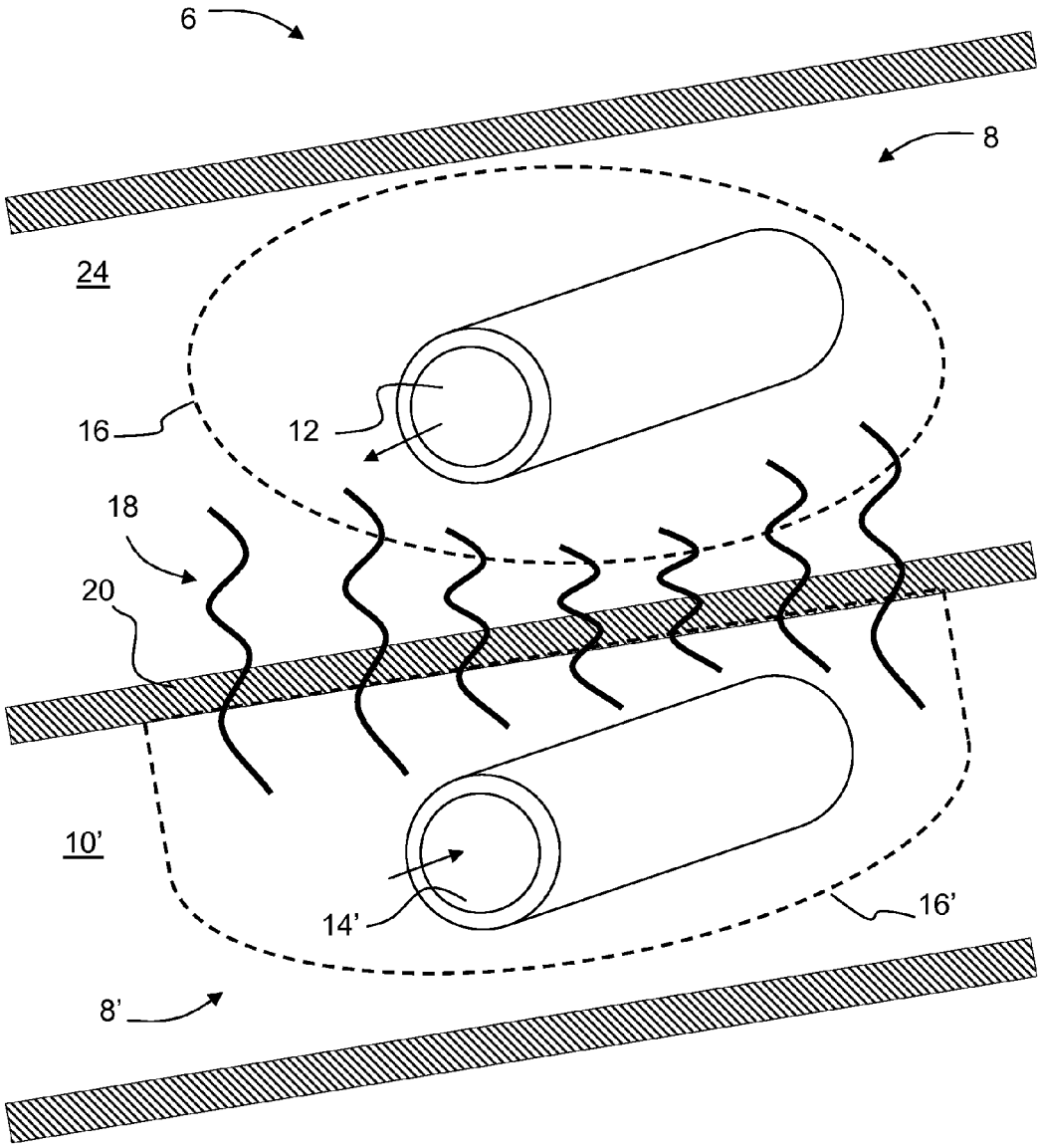
FIG. 6 shows the arrangement of a steam injection process in a first stratum not containing bitumen and the recovery of bitumen in a second stratum.

In another aspect, the invention provides a method involving the active heating of a first stratum containing a non-bitumen containing area to passively heat an adjacent second stratum. This aspect is illustrated by way of example in FIG. 6 wherein a steam injection well 12 is horizontally disposed within a non-bitumen containing area 24 of a first stratum 8. The well 12 introduces steam into the first stratum 8 thereby heating the stratum 8 in a manner similar to that shown in FIGS. 4 and 5. However, as the area 24 does not contain any bitumen, there is no need for any production wells in the first stratum 8. Therefore, the heat 18 applied to the first stratum 8 serves only to heat, via conduction, the adjacent second stratum 8'. The first stratum 8 can also potentially be heated by other techniques, inclusive of resistive electrical or electromagnetic means. Similar to the method described above and as illustrated in FIG. 3, the second stratum 8' contains a bitumen-rich area 10' and the transferred heat 18 serves to mobilize the bitumen therein, which is then collected in production well 14'. It is noted that the embodiment shown in FIG. 6 can also be modified to incorporate the use of a solvent injection well 22, as illustrated in FIG. 5, if needed and depending on the reservoir conditions. It will be understood that in the aspect shown in FIG. 6, typical SAGD equipment can be used but wherein the injection and production wells are placed in separate deposits. Thus, rather than directly heating a deposit with steam, the deposit (i.e. in stratum 18') is passively heated. In this aspect, it will be understood that the problems associated with the mixing of water and oil are avoided without the need for additional equipment. It will also be understood that, as described above, a solvent injection system as illustrated in FIG. 5 may also be incorporated into the stratum 8' to further enhance recovery.

Figure 7:
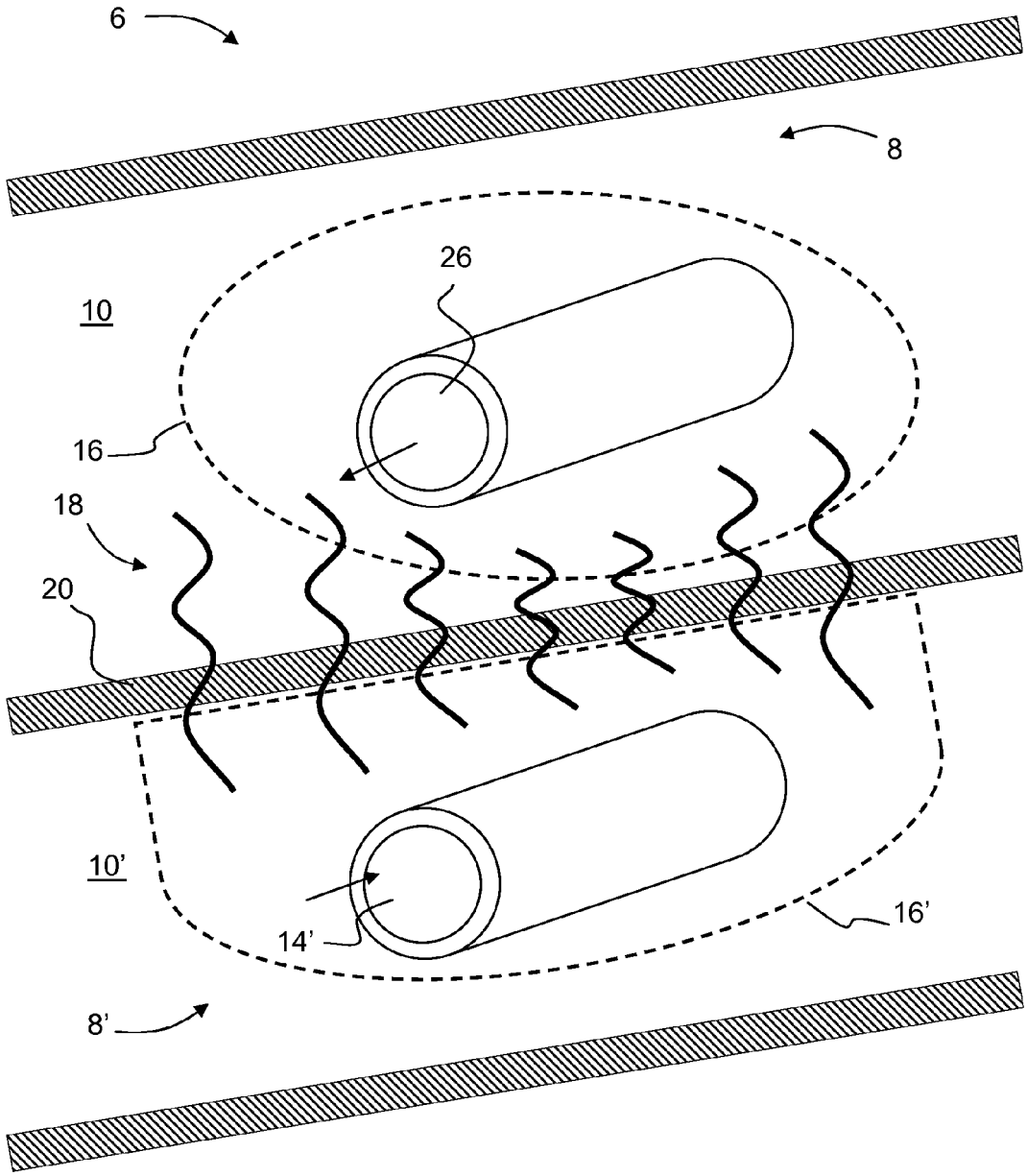
FIG. 7 shows the arrangement of an in-situ combustion process in a first stratum and the recovery of bitumen in a second stratum, whereby the recovery of bitumen from said first stratum in uneconomical.

In another aspect of the invention, FIG. 7 illustrates the use of an in-situ combustion (ISC) process as the active heat source to be applied in the first stratum 8. For example, if the first stratum 8 contains hydrocarbons but is not of a sufficient size or volume to warrant a SAGD or appropriate recovery process, then the hydrocarbon therein may be subjected to combustion, as known in the art. The same situation may occur in cases where the hydrocarbon material contained in the first stratum 8 is of poor quality and, therefore, has a low economic return on recovered yield. In these instances, as shown in FIG. 7, an ISC process can be applied to burn the bitumen in the first stratum 8. In such case, an oxygen injection well 26 is provided within the bitumen-rich area 10 of the first stratum 8. The well 26 serves to inject air, enriched air or oxygen into the surrounding area 10 to promote combustion, or burning, of the hydrocarbon fuel. The combustion process of the bitumen creates what is known in the field as a "fire flood", or a combustion zone that moves through the reservoir. The fire flood releases heat to the surrounding area 10 and transfers heat 18 via conduction through the barrier 20 to the adjacent second stratum 8'. It should be noted that due to the impermeable or partially permeable nature of the barrier 20, the combustion reaction is contained within first stratum 8 and does not directly affect the bitumen in an adjacent second stratum 8'. In a manner similar to that described previously with respect to other embodiments, the passive heat transfer 18 causes heating of the bitumen in the second bitumen-rich area 10', thereby preconditioning such bitumen, which is then collected by the second production well 14' contained in the second stratum 8'. It is again noted that the use of a solvent injection process, as shown in FIG. 5, may optionally be used with the embodiment illustrated in FIG. 7, as determined by the characteristics of the reservoir.

In the foregoing discussion, various embodiments have been described wherein bitumen is produced from one or more reservoirs or strata. As will be understood and known to persons skilled in the art, such removal of oil, and/or other related materials, results in the formation of a depleted pressure in the region of production. In such case, it will be understood that a pressure imbalance may develop, which may lead to the impairment of bitumen flow through the production system. To counteract this issue, it is common to inject some form of replacement component to counteract depletion voidage. In the case of a SAGD process, the injected steam may serve this purpose. Similarly, is a dilution process, the injected solvent fluid may serve this purpose. However, it will be understood that in cases where neither a SAGD nor a dilution process is used, some form of replacement fluid would generally be needed. Various types of pressure maintenance fluids are known in the art, such as diluents and solvents previously outlined, non-condensible gases (such as methane, $CO_2$, $N_2$), flue gas, etc. In a case where the oil in a preconditioned stratum is mobilized and produced solely by heating, a vertical injection well may be required for voidage replacement, particularly where the oil column may be associated with an underlying or adjacent aquifer. In the latter case, pressure maintenance would be desirable in order to retard the flow of formation water into the depleted zone.

The invention disclosed herein provides a method of bitumen recovery via thermal processing in which conductive heat losses are conserved and utilized to heat adjacent bitumen containing strata. Therefore, the invention utilizes a portion of the energy input to one reservoir to enable additional recovery of bitumen in an adjacent secondary zone. Furthermore, the thermal processing method of the invention does not require the continuous injection of steam into the secondary zone, thereby avoiding the issue of protracted mixing of water and bitumen in the secondary recovery zone. This improves production quality and efficiency as the flow rate of bitumen is not impeded and less secondary processing is required.

As may be held of benefit, start-up operations within the secondary zone may make use of an initial steaming process. For example, a limited start up number of cyclic steam stimulation cycles may prove of benefit in establishing a more rapid communication of a depletion chamber from a producer to an adjacent, directly heated zone. Once vertical communication through to the flow barrier between the two strata is achieved, such initial steaming would be terminated as the process continues through the pattern life by passive heat conduction as outlined. The objective of such start-up procedures would be to initiate and accelerate the initial development of a depletion chamber permitting a more rapid deployment of alternate recovery techniques, such as solvent processes, outlined.

Although the invention has been described with reference to certain specific embodiments, various modifications thereof will be apparent to those skilled in the art without departing from the purpose and scope of the invention as outlined in the claims appended hereto. The drawings provided herein are solely for the purpose of illustrating various aspects of the invention and are not intended to be drawn to scale or to limit the invention in any way. The disclosures of all prior art recited herein are incorporated herein by reference in their entirety.

What is claimed is:

1. A method of producing hydrocarbons from a subterranean formation comprising at least a first stratum and an adjacent, hydrocarbon containing second stratum, said first and second strata being separated by a barrier, the method comprising:

heating the first strata;

allowing heat from the first strata to be conducted into the second strata, said heat being sufficient to heat and reduce the viscosity of the hydrocarbons in said second strata; and, producing said reduced viscosity hydrocarbons from the second strata by gravity drainage of the hydrocarbons through at least one production well provided in the second strata;

wherein the heat conducted from the first strata to the second strata is the only source of external heat supplied to the second strata.

2. The method of claim 1 wherein said hydrocarbons comprise heavy oil or bitumen.

3. The method of claim 2 wherein said first strata contains no or a minimal amount of hydrocarbons.

4. The method of claim 3 wherein said first strata is heated with a heat transfer fluid, with steam injection, or by electrical or electromagnetic heating.

5. The method of claim 1 wherein said first strata further contains hydrocarbons.

6. The method of claim 5 wherein said first strata is heated by a steam assisted gravity drainage, SAGD, process.

7. The method of claim 6 wherein hydrocarbons are produced from the first strata.

8. The method of claim 5 wherein hydrocarbons in the first strata are combusted in-situ to produce heat.

9. The method of claim 8 wherein air, enriched air or oxygen is injected into said first strata to facilitate said combustion.

10. The method of claim 1 further comprising injecting a solvent into the second strata during or after the heating of the second strata to facilitate production of said hydrocarbons in the second strata.

11. The method of claim 1 wherein the barrier is impermeable or partially permeable to flow of hydrocarbon therethrough.

12. The method of claim 1, wherein the at least one production well is a generally horizontal well.

13. The method of claim 1, wherein the first strata is vertically above the second strata.

14. The method of claim 1, wherein the first strata is vertically below the second strata.

* * * * *